United States Patent [19]

Matschke

[11] Patent Number: 4,462,706

[45] Date of Patent: Jul. 31, 1984

[54] STACKABLE DOT MATRIX PRINTING CARTRIDGE MODULES

[75] Inventor: Arthur L. Matschke, Southport, Conn.

[73] Assignee: Baudex Corp., Westport, Conn.

[21] Appl. No.: 370,803

[22] Filed: Apr. 22, 1982

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,218,148 8/1980 Matschke ..... 400/124

FOREIGN PATENT DOCUMENTS 2539594 4/1976 Fed. Rep. of Germany ..... 400/124

2461206 6/1976 Fed. Rep. of Germany ..... 400/124

*Primary Examiner*—Paul T. Sewell

*Attorney, Agent, or Firm*—James J. Burke, II

[57] ABSTRACT

A high degree of flexibility and speed in dot matrix printing are achieved by providing printing cartridge modules that are so thin, a number can be stacked together and run simultaneously. Depending on the array used, several lines can be printed at the same time, or a single line can be developed from a standard dot matrix character into a fully formed character. In one embodiment, the print wires are formed into a linear array parallel to the flat side of the cartridge module, and the modules are stacked vertically with respect to the print medium. This embodiment is preferred for overlay printing. In a second embodiment, the print wires are formed into a linear array perpendicular to the flat side of the cartridge module, and the modules are stacked horizontally with respect to the print medium. This embodiment is preferred for multiple line printing, and has the additional advantage of being sufficiently flat to fit within the upper and lower planes of a ribbon cartridge. Both embodiments utilize the M-cell electromagnet actuator described in U.S. Pat. Nos. 4,134,691 and 4,218,148. While the mounting of the actuators and means for guiding the print wires differs considerably in the two embodiments, in all the cases the individual armature mounting and armature-print wire movement are in a single plane, and the angle between the print-wire axis and the armatures is less than 10°.

22 Claims, 17 Drawing Figures

STACKABLE DOT MATRIX PRINTING CARTRIDGE MODULES

BACKGROUND OF THE INVENTION

The present invention relates in general to dot matrix printing and, more particularly, it relates to assemblies of electromagnet print-wire actuators, such assemblies being referred to herein as cartridges.

In dot matrix printing, a plurality of electromagnets or solenoids are used to drive individual print wires, upon actuation, into the printing medium, typically an inked ribbon, to create a dot impression on the paper. Characters are created with a linear array of print wires, vertically arranged, which may be 6 to 9 wires high, by selectively actuating print wires 4 to 6 times as the paper moves horizontally one character width. A very common "matrix" for printing one character is a rectangle 7 wires high by 5 wires wide. While print heads including a full 35 wire array are known, it is much more common to use a single array of 7 wires that is actuated 5 times to form a character. This is so, because as can readily be appreciated, a printing head with a 35 wire array is necessarily large and cumbersome, and in it the duty factor (the percentage of use for a given wire) varies from very high for some wires to very low for others, leading to uneven wear problems. A seven-wire head has much lower mass, and the duty factor is much more even.

In the early days of dot-matrix printing, the preferred actuators were linear solenoids, e.g. a cylindrical, spring-mounted armature surrounded by a coil and having a print wire secured in one end thereof. The energy of actuation was used to drive the print wire and tension a spring for the return stroke. A print head having seven such solenoids might have one directly on the print axis and the six others distributed therearound on a mounting surface that was spherical. While the print wires were thus all of substantially the same length, one was straight and the rest were curved. It was apparent that a substantial portion of the available energy was dissapated as friction (heat) in guiding the curved wires.

To reduce frictional losses, a whole generation of print heads was designed that had the print wire driven by a pivoted armature to which it was attached at right angles. With this arrangement, only the tip of the armature was near the print axis, the coils were placed in a circular array around it, and wire curvature was greatly reduced.

Prior workers have labored ingeniously to reduce the mass and increase the speed of dot matrix print heads, but certain limits are inherent. First, there is the finite rise and die-away time described by the hysteresis curve of any electromagnet. Since many dot matrix printers are designed to print multiple copies, delivered print wire power is also a design factor. There are also practical limits to the speed of carriage movement. In this connection, the development of electronics allowing the head to print in both directions has been of great assistance to overall speed, inasmuch as this eliminates "dead" carriage return time. But carriages moving at high acceleration curves tend to malfunction frequently, are expensive to build, and are noisy.

OBJECTS OF THE INVENTION

A general object of the present invention is to provide thinner dot matrix print heads.

Another object of the present invention is to provide dot matrix print heads that are so thin that a number of them can be mounted on a carriage together, whereby print speed and/or versatility are increased.

Yet another object of the present invention is to provide dot matrix printing cartridge modules that are stackable.

A still further object of the present invention is to provide a dot matrix print head that is thinner than a ribbon cartridge.

Still another object of the present invention is to provide thin dot matrix print head cartridges wherein the linear array of print wires may be either parallel or perpendicular to the thin side.

A still further object of the present invention is to provide dot matrix print heads wherein print wire wear can be readily compensated.

Various other objects and advantages of the invention will become clear from the following description of embodiments, and the novel features will be particularly pointed out in connection with the appended claims.

THE DRAWINGS

Reference will hereinafter be made to the accompanying drawings wherein.

Figure 8:
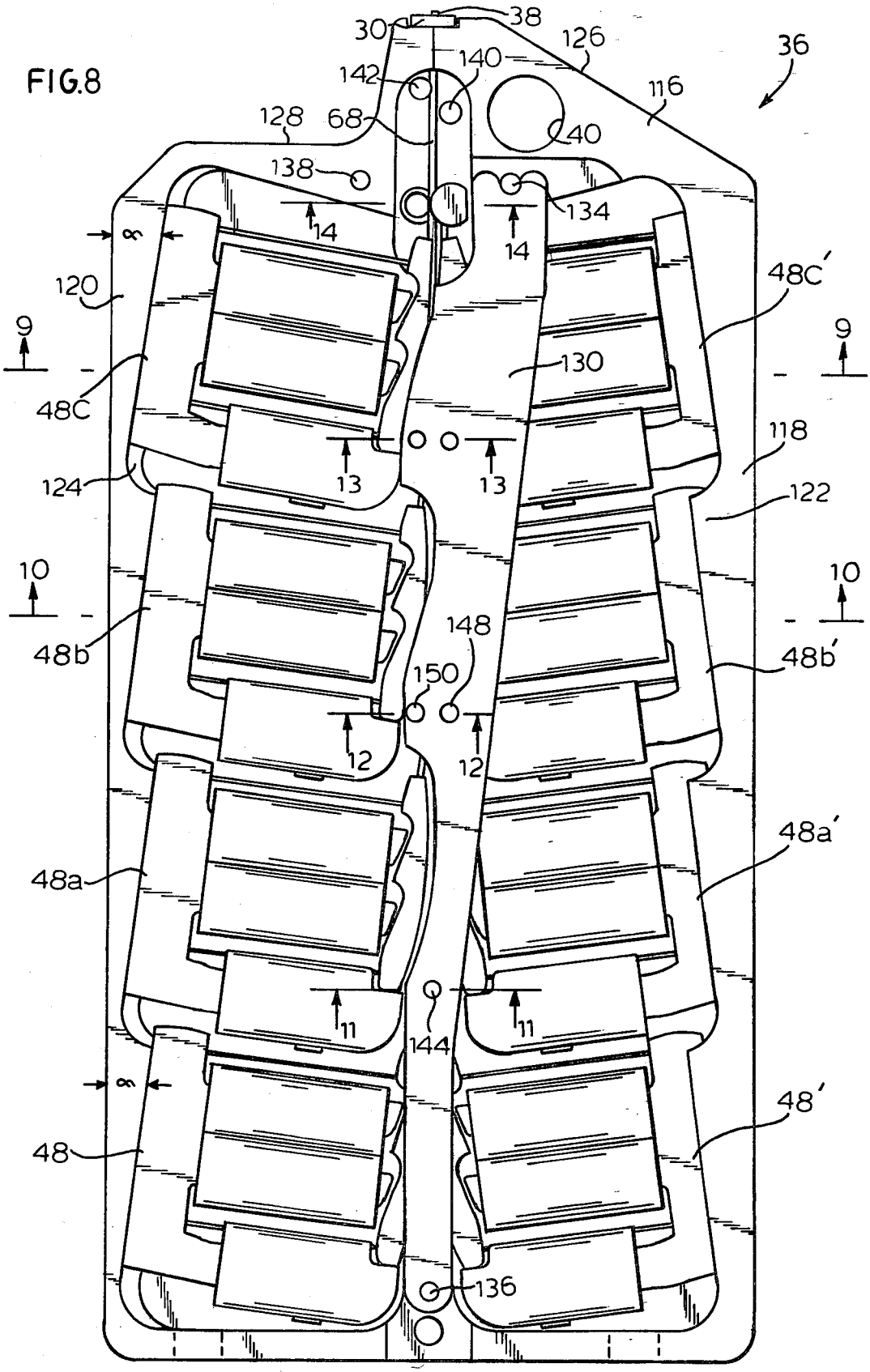
FIG. 8 is a plan view of the H-type cartridge body, with the retainer assembly partially cut away, and showing how the print wires are guided into a linear array that is perpendicular to the flat side of the body.
Figure 15:
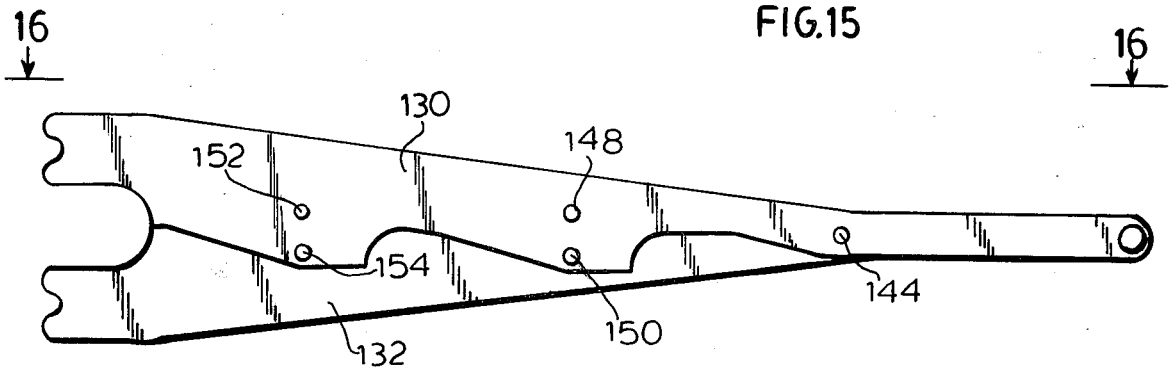
Figure 16:
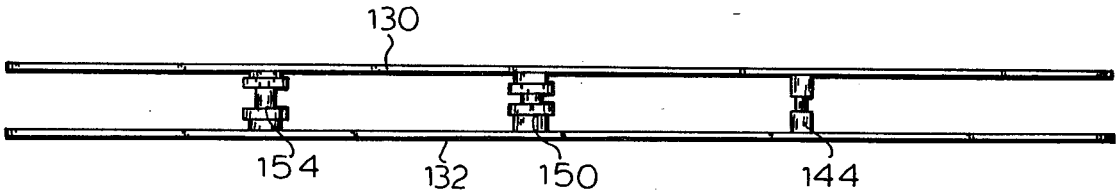

FIGS. 11, 12, 13 and 14 are cross-sectional views taken along lines 11—11, 12—12, 13—13 and 14—14, respectively, of FIG. 8, and showing the function of the guide posts at each respective location;

FIG. 15 is a plan view of the wire retainer assembly for the H-type cartridge body; and FIG. 16 is an elevation view of the wire retainer assembly for the H-type cartridge body.

DESCRIPTION OF THE EMBODIMENTS

Figure 1:
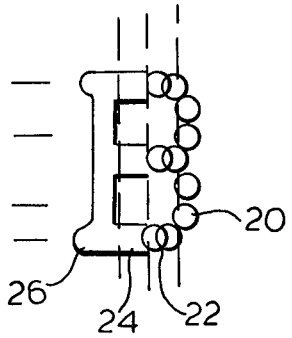
FIG. 1 is a printed character illustrating (a) standard dot matrix printing, (b) double and (c) triple overlays and (d) a fully formed character, all of which are possible with the present invention.

Understanding of the invention will be facilitated by consideration of various types of dot matrix printing, and attention is directed to FIG. 1, which depicts the letter "B", greatly enlarged, and which is divided into four vertical zones 20, 22, 24, 26. In zone 20, there is illustrated the type of character formed by a single pass of a 7-wire head. The individual dots are clearly visible, and while suitable for many used (tickets, receipts, etc.) such characters are unsuitable for other uses (business letters, reports, etc.). Zones 22 and 24 show double and triple overlay printing, respectively, wherein the individual dots are progressively formed into more continuous strokes with resultant improvement in character quality, and in zone 26, after a fourth pass, the character is called "fully formed", and is the full equivalent of either a conventionally typewritten character or one formed on so-called character printers.

With the present invention, any of these types of printing may be carried out, as will be set forth in detail hereinbelow. As is manifest, there is a trade-off between overall printing speed and quality of individual characters, but at levels which are deemed to set a new standard in the art.

Figure 2:
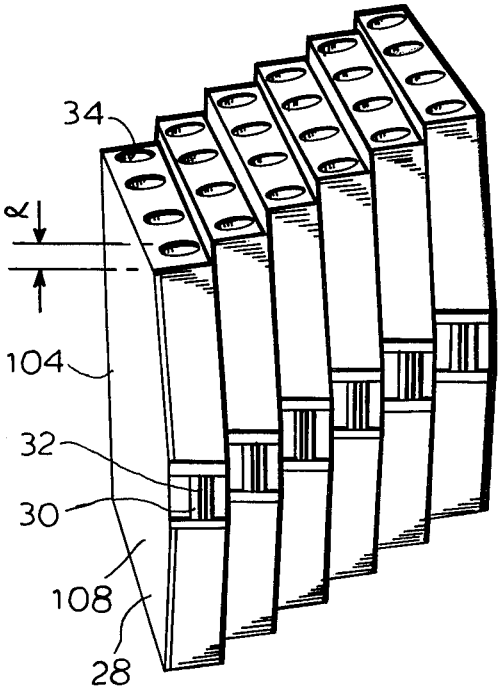
FIG. 2 is a perspective view of a stacked array of vertically mounted ("v") printing cartridges, which cartridges comprise one embodiment of the present invention.

FIG. 2 is a perspective view of six "V" type cartridge modules 28, each including a nose bearing or jewel 30 retaining a vertical array of print wires 32, generally six to eight and most commonly seven. Also visible in FIG. 2 are the mounting holes 34 in the side wall of module 28, each hole 34 containing a screw (not shown) which holds an individual electromagnet actuator (FIG. 4) in place.

The important feature of FIG. 2 is that each successive module 28 may be vertically offset from its neighbor by the distance $\alpha$. It is an important feature of the invention that the absolute value of $\alpha$ can be varied from zero, to a fraction of a wire diameter, up to full line spacing. Thus, the various types of overlay or fully-formed character printing can be carried out or, alternatively six separate lines can be printed simultaneously in the single dot mode. However, in the latter case, it is preferred to employ the "H" type cartridge module, for reasons set forth in connection with FIG. 3 below.

Those skilled in the art will appreciate that a variety of means could be employed to mount a plurality of cartridge modules 28 with a desired value of $\alpha$.

Figure 3:
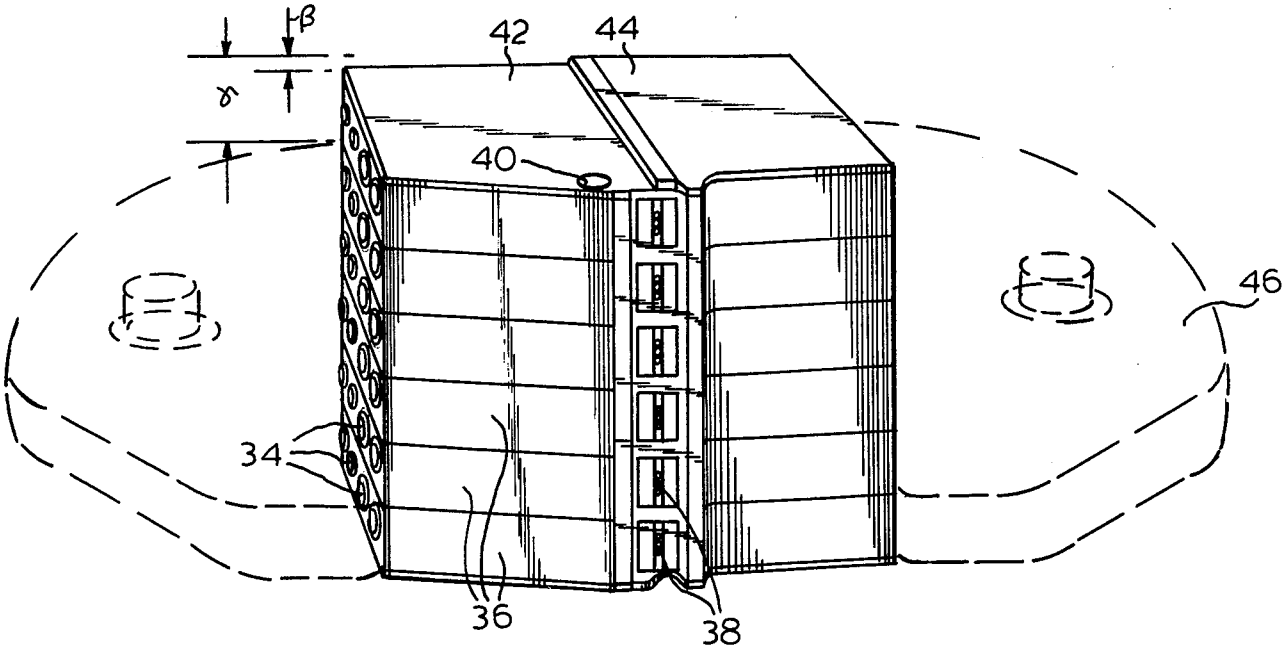
FIG. 3 is a perspective view of a stacked array of horizontally mounted ("H") printing cartridges, which cartridges comprise a second embodiment of the present invention.

FIG. 3 is a perspective view of six "H" type cartridge modules 36, which differ from the "V" modules 28 in that the vertical array of print wires 38 in this case is perpendicular to the flat side of the module, whereas in the FIG. 2 "V" module 28 the array 32 is parallel to the flat side. As a result, in order to present a vertical wire array to the printing medium in each case, in FIG. 2 the modules 28 are stacked side-by-side in the vertical position, whereas in FIG. 3 the modules 36 are stacked one on top of the other in the horizontal position.

There are several important features of this embodiment of the invention that can be appreciated from FIG. 3.

Since all modules 36 are in vertical alignment, a hole 40 in each will retain a rod that holds the stack in place.

More important, it can be seen that the left halves 42 of modules 36 are lower, or vertically offset from, the right halves 44 by the distance $\beta$. The overall thickness of modules 36 ($\gamma$) is greater than a conventional line spacing, but since the individual vertical arrays 38 are on the centerline axis of the modules, the vertical distance between each array is closer by $\beta$, so that $$\gamma-\beta=\text{one line spacing}$$

and a stack of modules 38 are most appropriate for printing separate lines simultaneously. It is appreciated that the term "line spacing" is somewhat arbitrary and is not defined with precision, but it should also be pointed out that no matrix print head has been heretofore known which even remotely approached this capability. Typical values of $\gamma$ are about 0.300–0.350".

With appropriate adjustments in the electronics, it will be appreciated that the stack of cartridge modules shown in FIG. 3 could also be used to print three lines with a single overlay or two lines with a double overlay, with the results set forth above in connection with FIG. 1. More important, and unlike the Series V cartridge printhead modules for multi-line printing (and typified in paramutuel ticket-printing where counterfeiting is a concern and the paper is of high value), the series H cartridge module printhead stacking permits column printing without electronic delay or paper manipulation, and this can be done up to the extreme edge of the ticket strip. Series V printing requires electronic delay accomodation in one form or another to achieve justified print, as well as print-ticket reverse motion to achieve printing up-to-the-edge of the ticket.

A still further feature of the exceptional flatness of module 36 is that one or in certain cases two modules will fit within the upper and lower (horizontal) planes of a ribbon cartridge, shown in phantom at 46. For printers where only one printing head is desired, this gives the design engineer an exceptional degree of freedom.

Figure 4:
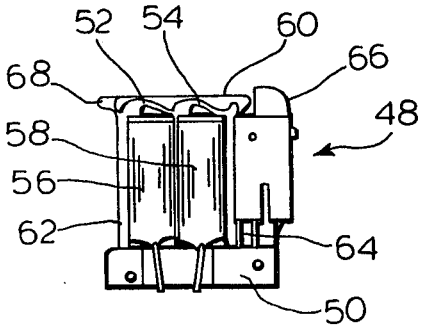
FIG. 4 is a side elevation view of the M-cell electromagnet print wire actuator utilized in all embodiments of the invention.

FIG. 4 illustrates the electromagnet actuator 48 used in all embodiments of the present invention, and which is described and claimed in my previous U.S. patents as set forth hereinabove. For present purposes, it is sufficient to note that each such actuator comprises a base 50 having two pole pieces 52, 54 around which are coils 56, 58, an armature 60 supported on two resilient rods 62, 64 and a resilient stop or damper 66. The armature 60 is secured to and drives a print wire 68. An important feature of actuator 48 is that movement of rods 62, 64, armature 60 and print wire 68 is in a single plane, the plane of the paper in FIG. 4. A feature of the present invention, in both the horizontal and vertical embodiments, is that individual actuators are mounted so that this is preserved in every case, with each print wire and its associated armature and mounting rods moving in its own printing stroke plane, the array in a given module forming a set of such planes, each separated by one wire diameter. Actuators 48 are described in detail in the aforesaid patents, the disclosures of which are incorporated herein by reference.

Figure 5:
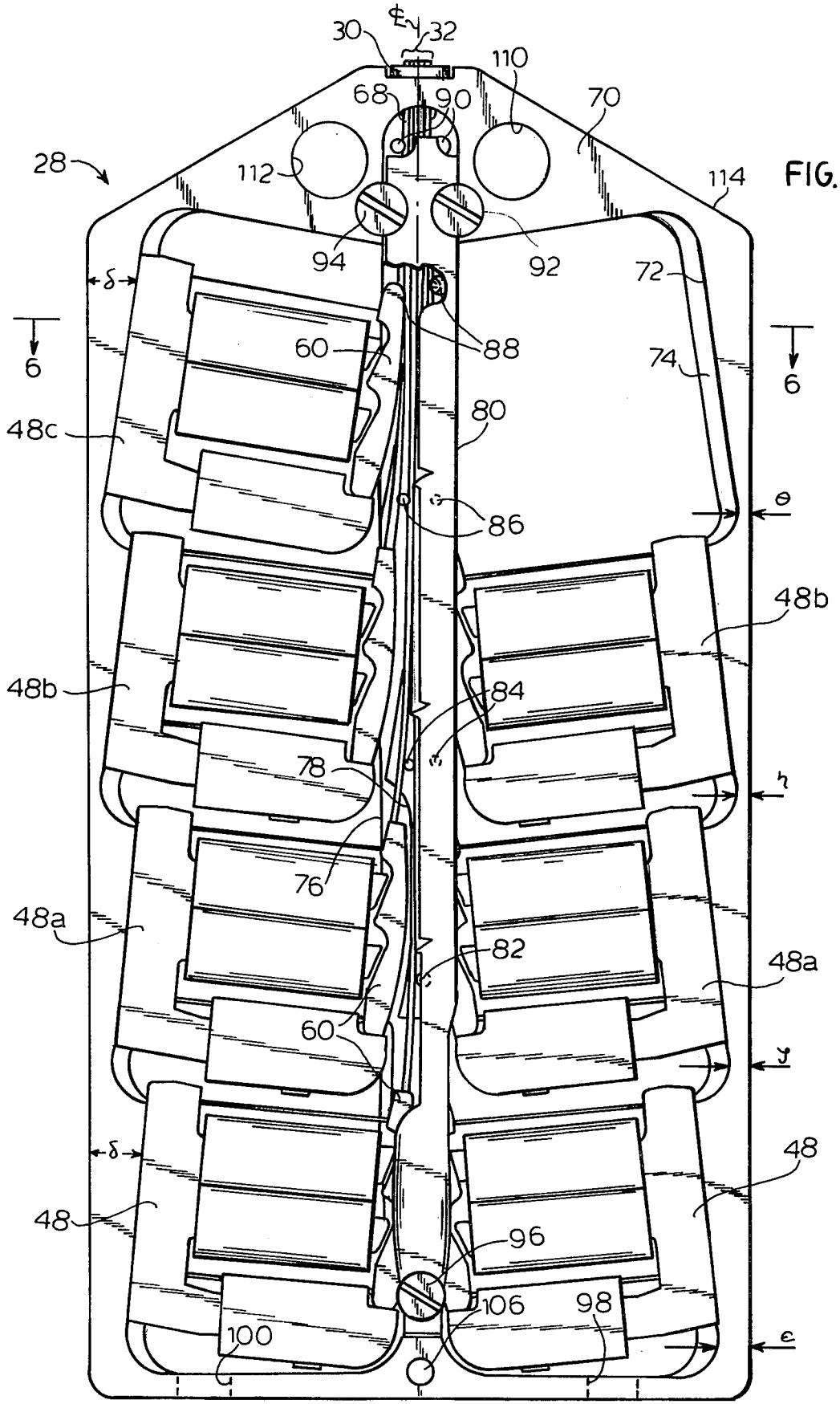
FIG. 5 is a plan view of the V-type cartridge body, with the retainer partially cut away, and showing how the print wires are guided into a linear array that is parallel to the flat side of the body.

FIG. 5 is a plan view of the "V" type cartridge module 28, with the cover plate removed. It comprises a generally flat, generally rectangular frame member 70 which has, in the inner surface of its long sides, eight actuator mounting surfaces 72 (four per side). As shown in FIG. 5, seven actuators 48, 48*a*, 48*b*, etc. are shown in place on these mounting surfaces.

Each mounting surface 72 is at an angle to the centerline axis which varies from $\delta$ for the surfaces nearest the nose to $\delta'$ for the furthest surface. It has been determined empirically that $\delta$ should be greater than $\delta'$, but only by less than about 4°. The closer, shorter wires are bent and hence tensioned just a little more. The further-away wires have more guide support, plus support from wires forming the outer layers of the array. This arrangement, insofar as it is known from tests to date, allows all actuators 48 to run evenly and "see" an equal printing load. While not known with precision, it is believed that the larger mass of the longer wires is equalized by the frictional moments and greater bending stress in the shorter ones. In absolute terms, the values of $\delta$ and $\delta'$ fall in the range of 10° to 5°.

What is distinct about the original mounting surfaces 72 is that, for actuators 48 they are a distance $\epsilon$ either from the centerline axis or from the long side of frame 70, for actuators 48*a* this distance is $\zeta$, one wire (68) diameter different, for actuators 48*b* the distance is $\eta$, one wire diameter different, and for actuator 48*c* the distance is $\theta$, with the same relation. Thus, $$\epsilon-\theta=\text{three wire diameters}$$

Actuators 48 are thus closest to the centerline, and their wires 68 are the center ones in array 32. Actuators 48*a* are one diameter further away from the centerline and their wires 68 are outside of and adjacent to the center ones.

The individual holes for mounting and securing actuators 48 (34 in FIG. 2) are not shown in FIG. 5. However an important aspect of mounting is that each mounting surface 72 has adjacent thereto a flat, inwardly extending shoulder 74 which provides for exact alignment of the bases 50 (FIG. 4) of actuators 48, which rest thereagainst, and which also prevent any skewing of actuators 48 during use. As noted below, holes 34 are oversized, so that individual cells can be moved on their respective mounting surfaces to compensate for wire wear.

Figure 7:
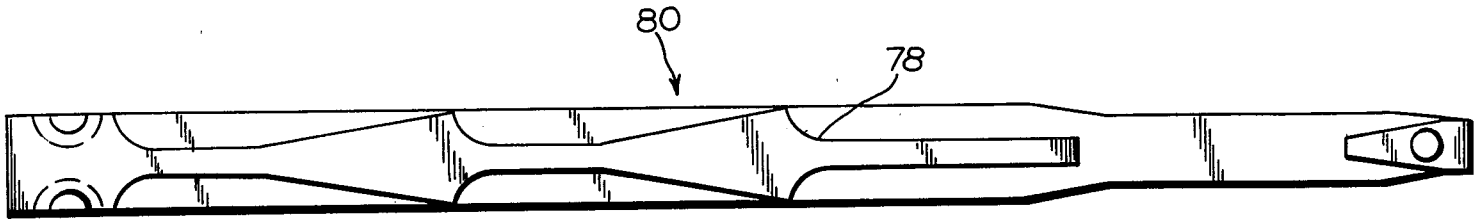
FIG. 7 is a plan view of the retainer which, in conjunction with the guide pins, guide the wires in the V-type cartridge body.

In this "V" embodiment the guiding of the print wires from the respective armatures into the nose bearing is relatively simple and straightforward. In essence, cartridge body 70 includes an integral, longitudinally-running support member 76 the inner surface of which has cut away portions 78 to accomodate armatures 60 and movement of same. The flat, upper surface of member 76 provides one guide surface for wires 68, and a mating but spaced surface is provided by wire retainer element 80, shown more clearly and from the underside in FIG. 7. While support 76 is preferred as an integral member, it could also be separate, as element 80. Member 76 and element 80 define two walls between which wires 68 move, and further guidance is provided by a single guide pin 82, (which separates two wires) and four pairs of guide pins 84 (which enclose two wires and have two wires exterior), 86 (which enclose four wires and have two wires exterior), 88 (which enclose six wires and have one wire exterior), and 90 (which enclose seven wires). Of course, in an eight wire head there would be two wires exterior to pins 88 and pins 90 would enclose all eight. The respective cut-away portions of member 76 and element 80 combine to form internal cavities for armatures 60 and movement of same while at the same time providing guide surfaces, with pins 82–90, that guide wires 68 into nose bearing 30 in a compact, lightly stressed bundle.

Retainer element 80 is secured into cartridge 70 with two screws 92, 94 at the front (nose) end and a single screw 96 at the rear. Pins 82–90 are set in holes (not shown) drilled in member 76.

Figure 6:
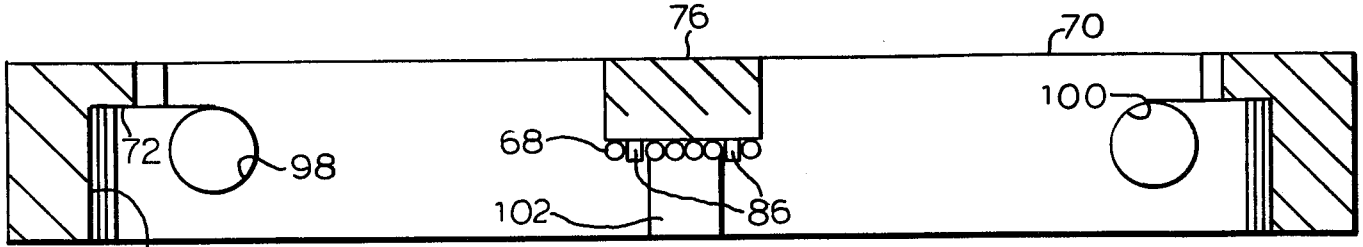
FIG. 6 is a cross-sectional view taken along line 6—6 of FIG. 5.

FIG. 6 is a cross-section taken along line 6—6 of FIG. 5, from which, for clarity of illustration, actuators 48 etc. and retainer 80 have been removed. In other words, FIG. 6 shows the cross section of an empty cartridge body 70. Mounting surface 72 and shoulder 74 are clearly seen, as are holes 98, 100 in the rearward wall of body 70 which are provided to allow for egress of the wires from coils 56, 58 of actuators 48. An inwardly-extending boss 102 on the same rearward wall of body 70 is drilled to accomodate both wire retainer screw 96 and a mounting locator pin 104 in hole 106 which secures one cover plate 108 (FIG. 2).

Referring again to FIG. 5, the front (nose) end of body 70 is provided with a pair of holes to accomodate the mounting means described in the aforesaid co-pending application. Further, the front wall 114 of cartridge 70 is angled back, in order to minimize over-all mass.

Figure 8A:
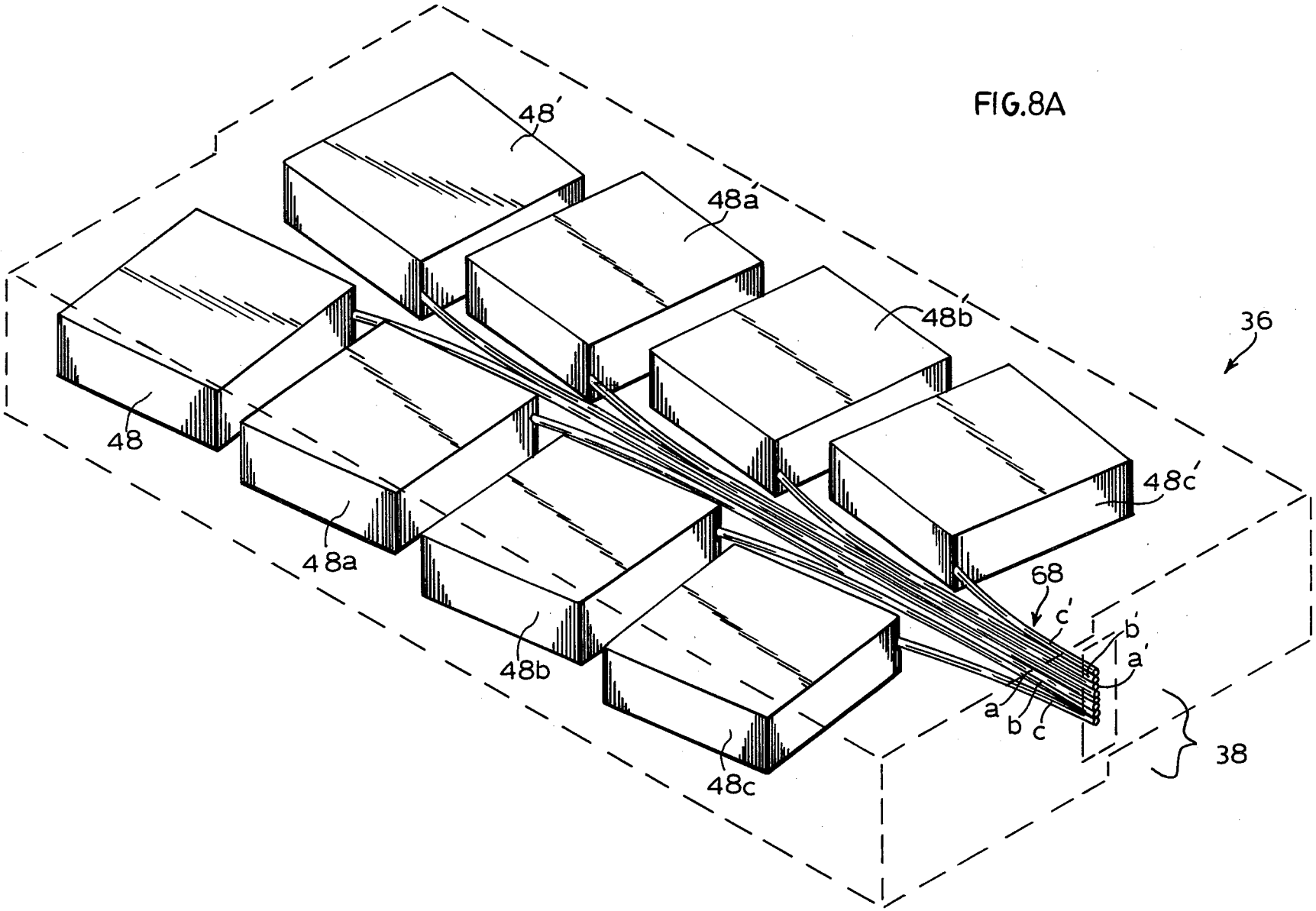
FIG. 8A is a simplified, schematic perspective view illustrating placement of the actuator mounting surfaces in the H-type cartridge body.

The "H" or horizontally mounted embodiment of the invention is considerably more complex in the arrangement of actuators which in this case result in a vertical array of print wires 38 that is perpendicular to the flat side of the module (36 in FIG. 3), and to facilitate understanding of this aspect of this embodiment, attention is directed first to FIG. 8A, which is a greatly exaggerated and greatly simplified view of eight actuators 48 as they are essentially arranged in this embodiment. As in FIG. 5, the pair of actuators furthest from the nose is labelled 48, the next closest pair 48*a*, and in the same fashion 48*b* and 48*c*. Once again, pair 48, 48' furthest from the nose, are the central wires in array 38, but in this case it is important to note that 48' wire is above the 48 wire. Thus, actuator 48 is mounted one wire diameter lower than actuator 48'. This accounts for the vertical offset between left (42) and right (44) sides noted hereinabove in connection with FIG. 3. Moving closer to the nose, actuator 48*a* is a wire diameter lower than actuator 48, actuator 48*a'* is a wire diameter higher than actuator 48', with the result that the wire axes of actuators 48*a* and 48*a'* are separated by three wire diameters (wires 68 and 68' plus half of each of wires 68*a* and 68*a'*). The same higher/lower relation holds true for the remaining actuators, so that the highest wire is 68*c'* and the lowest wire is 68*c*.

Figure 10:
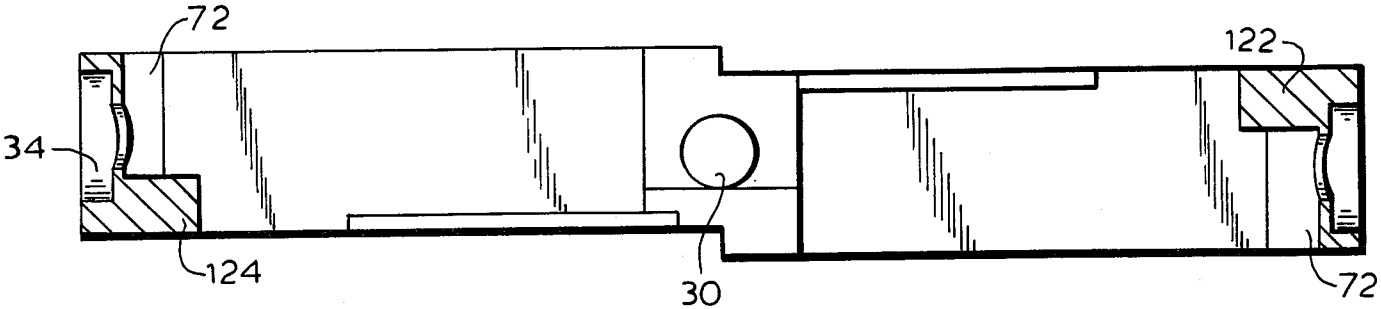
FIG. 9 and FIG. 10 are cross-sectional views taken along lines 9—9 and 10—10 of FIG. 8.
Figure 9:
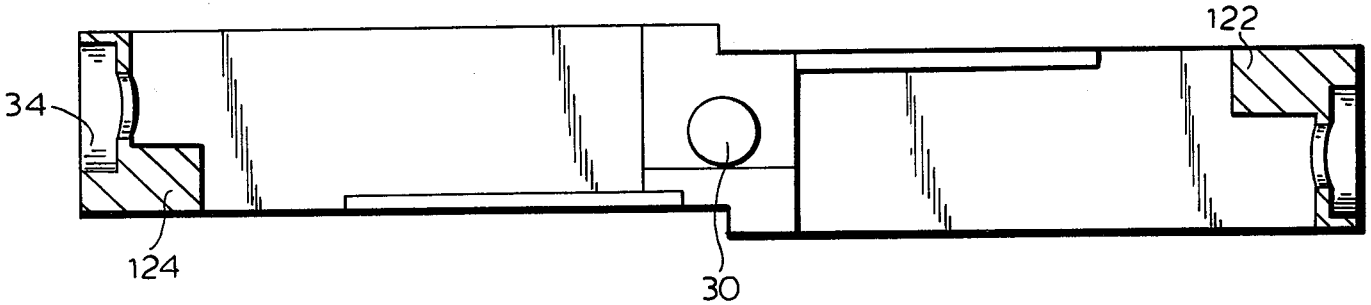

How this arrangement is carried out in practice is illustrated in FIGS. 8–10, and attention is directed thereto. FIG. 8 looks substantially similar to FIG. 5 but, in this "H" embodiment, the frame 116 is bifurcated into offset left 118 and right 120 portions, with the mounting shoulders 122, 124 being on the top in the former case and on the bottom in the latter. As one proceeds from the rear to the front mounting surfaces (48 to 48*c* etc.) it is the thickness of these shoulders which diminish by a wire diameter on one (the upper) side and increase on the other (lower side), which establishes the positions of actuators 48 etc. in the relationship shown in FIG. 8A. The mounting surface/shoulder arrangement could, of course, be different, as long as the FIG. 8A arrangement is observed.

One feature of the two embodiments that is the same is the angle $\delta$, $\delta'$ of mounting surfaces 72 are the same: less than 5° higher at the front and than at the rear, for the same reasons as set forth hereinabove in connection with FIG. 5.

As shown in FIG. 8, the overall shape of frame member 116 differs from the FIG. 5 embodiment in that only one side of the front edge 126 slopes back to reduce mass, while the other side 128 has been cut back much more severely. This is not a necessary feature, but was done in this case to facilitate mounting an array of these modules in a particular ticket printer.

The arrangement by which the print wires are guided from the respective armatures up to the nose bearing 30 is similar in plan to the FIG. 5 embodiment but somewhat more complex in execution. A pair of wire retainer plates 130, 132 are employed. In FIG. 8, only the top one is shown; bottom plate 132 is a mirror image of plate 130, as seen in FIG. 15. Thus, at the top, pins 134 and 136 secure plate 130, and the bottom plate is secured by (common) pin 136 at the rear and by pins 138 at the front. The purpose of these plates is to retain three sets of guide pins therebetween, shown in FIGS. 11–13. A fourth set, supported only by frame 116, is shown in FIG. 14. A fifth set, pins 140, 142, merely guides the assembled six-to eight-wire set into nose bearing 30.

In FIG, 11, a single pin 144 has an annular groove 146 two wire diameters wide which accomodates the wires from actuators 48 and 48', the central wires in the array.

Figure 11:
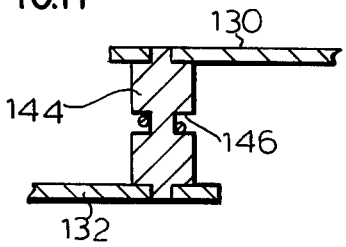
Figure 12:
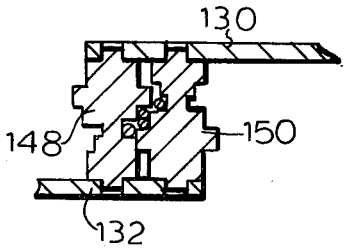

In FIG. 12, two pins 148, 150 are needed and form therebetween a vertical channel for the two wires shown in FIG. 11, plus an offset, lower channel for the wire coming from actuator 48*a* and an offset higher channel for the wire from actuator 48*a'*.

Figure 13:
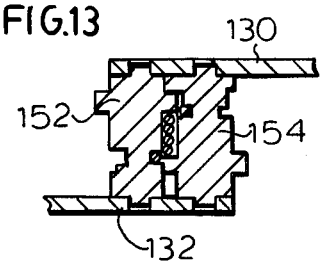
Figure 14:
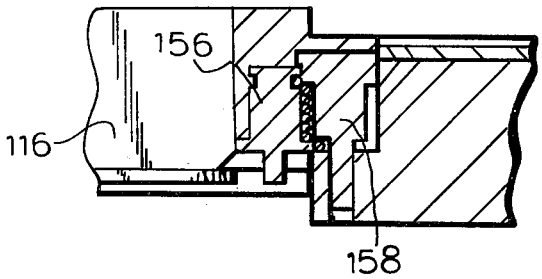

At the FIG. 13 position, two guides 152, 154 are again required and the arrangement is similar: a vertical channel for the four wires in FIG. 12, plus upper and lower offset channels for the wires from actuators 48*b* and 48*b'*. The FIG. 14 guides 156, 158, set in the frame 116, provide a six-wire vertical channel plus offset channels for the outermost wires in the array, coming from actuators 48*c'* and 48*c*. In a six-wire head, these pins would not be needed.

The discussion which follows is directed to use and operation of both H and V type modules, and deals with preferred embodiments which have been built and tested; it should not, however, be construed in a limiting sense.

The cartridge modules have a print stroke of 0.018"–0.020" and a dynamic range which begins closer to the print head, with as little as 0.002" clearance between the wire-end and the paper.

Those skilled in the dot matrix printing art will appreciate that materials of construction are constrained only by the requirements they be non-magnetic except for the print cells. Thus, in models produced to date, all cartridge elements have been fabricated from aluminum. Guides are phosphor bronze or, near the nose, hardened steel. For applications where tolerances are somewhat greater and duty cycles less than extreme, precisionmolded plastics, such as crossed polymer PVC and ABS may be used, even though heat dissipation is less. For example, the latter would be preferred in printers for the home computer market.

The cartridge modules are designed to be used for high definition printing using mylar and other non-fabric film ribbon. Film ribbons of high contrast inking materials available as "multi-strike" having four to six overstrike capability are recommended. Being able to print on the thinner films (0.0015" to 0.003") at high speed, adding the precision dot performance of the cartridges which have long parallel print-wire layouts, means the best obtainable print quality from the dot matrix art, and at high speeds. The print wire-ends are not machined in assembly of the cartridge, but rather are pre-shaped. They can be made pointed or domed to obtain small dot precision. Such precision and print contrast enhances the dot-overlay technique of full-character printers by improving control of the density, size and location of the dots. Web or nylon ribbon can be used at a reduction in print quality.

Cartridges are driven by an unsophisticated electronic circuit of 2.2 amperes peak pulse current and a 26–60 volt supply depending upon the number of copies and other service features. These specifications apply to either the H or V Series of modules.

Print wires are adjustable. This is effected by making the mounting holes for individual actuators (34 in FIG. 2) oversize, and initially mounting each activator at the rear of its mounting surface. About 0.020" is preferred as an adjustability range, which compensates for wire wear. It is a convenient feature that this can be carried out in situ, without even removing the cover of a module or disassembling a stack of same. If a printcell malfunctions, the print wire-cell can be replaced and the wire ends adjusted. Modularity, re-positioning of the print-wires and margin in the rated performance of the electomagnet make life expectancy very high.

The main shape advantage of the Series H is the compactness. The Series H can be encapsulated within the overall height of any standard ribbon cartridge. The result is a true one-piece ribbon and head "slab". The slab-like shape, shown in the drawing offers new freedom to the equipment designer. In the Series H, the minimum vertical displacement is 0.300"—that distance which is the minimum cartridge dimension controlling stacked row-centers. Horizontal row-center displacement can be zero in the Series H and is typically installed in columns.

The Series V offers variety, including combinations of vertically displaced wire-rows having different wire counts. Row centers are 0.280" and vertical row separation can be arranged for printing dot-overlay, OCR, and print-row continuity for graphics. In addition, multiline and multi-color are technically simplified. Multicolor printing can be done with multi-colored ribbon fabricated in a parallel mode—the most economical way to produce that commodity.

Printing parallel multi-lines is more efficient than running serial printhead carriages at acceleration curves which eventually cause machine malfunction and keep printer noise at high levels. By adding memory, multiline printing of 600 or 800 characters-per-second is achievable on a routine basis. Cartridge modules installed in special-purpose printers increase their print speed capacity up to 1,200 cps.

An important aspect of module printing is that one machine chassis will accomodate the printing specialities of color, high thruput, OCR, fully-formed and graphics by virtue of the associated electronics. It is not impractical to assume that a basic chassis can be upgraded by the addition of power, electronics and additional cartridges. The latent mechanical features required of a lesser model would be a platen of increased height (to accomodate several-line printing), and space for increased electronics and power.

All cartridges are speed-rated for 1,000 Hz service, with a substantial safety margin to insure longer cartridge life with less maintenance. Cartridges weight approximately 100 gms. Row-center tolerances in the Modules are ±0.002" to ±0.006" per module.

Various changes in the details, materials, steps, and arrangements of parts, which have been herein described and illustrated to explain the nature of the invention may be made by those skilled in the art, within the principle and scope of the invention as defined in the appended claims.

What is claimed is:

1. A stackable dot matrix printing cartridge module comprising:

a cartridge body, said body comprising a thin, flat, open-sided frame of generally rectangular shape and including on the inner, long sides of said frame a plurality of electromagnet print-cell mounting surfaces at a small, acute angle to the center-line axis of said body, and on one short side a nose bearing for retaining a plurality of print-cell printing wires in a contiguous linear array;

said linear array being formed in part by said print-cell mounting surfaces being successively offset by one wire diameter;

a plurality of electromagnetic print-cells mounted on said mounting surfaces, each said cell having an armature located near the center-line axis of said body at said small, acute angle thereto, said armature being moveable in a printing stroke plane;

a plurality of print wires attached to the forward end of each said armature and coaxial therewith, each said print wire being of a length to extend from its armature into and through said nose bearing and forming collectively said contiguous linear array;

said mounting surfaces being positioned so that each said armature and print wire in said linear array moves upon actuation of a cell without angular deviation from said printing stroke plane; and guide means along said center-line axis adapted to retain and guide each said print wire between each said armature and said nose bearing within said printing stroke planes.

2. The cartridge module as claimed in claim 1, wherein said small, acute angle is less than 10°.

3. The cartridge module as claimed in claim 1, wherein each said printing stroke plane is parallel to and within the thin flat sides of said body.

4. The cartridge module as claimed in claim 2, wherein said angle to the centerline axis and the angle of said mounting surfaces are the same, said angle decreasing with distance from said nose bearing for successive pairs of mounting surfaces.

5. The cartridge module as claimed in claim 4, wherein said angle decreases from about 9° to about 5°.

6. The cartridge module as claimed in claim 1, and additionally comprising means adapted to permit stacking a plurality of said cartridge modules in adjoining relation along said flat sides, said means including a plurality of holes between the flat sides of said frame.

7. The cartridge module as claimed in claim 1, and additionally comprising cover plates attached to and covering one or both sides of said open frame.

8. The cartridge module as claimed in claim 1, wherein each said print cell includes a base secured to a mounting surface, and each said armature is secured to a base by a pair of resilient rods, said rods moving only in said printing stroke plane upon actuation of a cell.

9. The cartridge module as claimed in claim 1, and additionally comprising means adapted to change the position of said print cells on said mounting surfaces, thereby compensating for print wire wear.

10. The cartridge module as claimed in claim 9, wherein said position changing means comprise mounting screws adapted to secure said print cells onto said mounting surfaces from the exterior of said frame, and holes for said screw in said frame, said holes being oversized.

11. The cartridge module as claimed in claim 1, wherein said linear array is perpendicular to said printing stroke planes and said flat sides, and additionally comprising:

side walls adjacent each said mounting surface;

said side walls each increasing in thickness by one wire diameter with distance from said nose bearing;

said side walls being along the bottom of said frame along one long side and along the top of said frame along the opposed long side;

whereby print wires from the furthest actuators from said nose form the centermost wires of the linear array and print wires from the closest actuators form the outermost wires of said array.

12. The cartridge module as claimed in claim 1, wherein said printing stroke planes are the same, and said linear array is in said plane, parallel to and between said flat sides, and additionally comprising:

each said mounting surface is closer to said centerline axis by one wire diameter with distance from said nose bearing;

whereby print wires from the furthest actuators from said nose form the centermost wires of the linear array, and print wires from the closest actuators form the outermost wires of said array.

13. The cartridge module as claimed in claim 11, wherein said guide means comprise:

a pair of elongate flat plates extending from the front to the rear walls of said frame along said centerline axis on the top and bottom flat sides of said frame;

a plurality of guide pin pairs spaced at intervals between said plates and adapted to guide said print wires into said perpendicular array at said nose, pairs closer to said nose enclosing and guiding more said wires; and an additional guide pin pair secured in said frame adjacent said nose and guiding all said wires thereinto.

14. The cartridge module as claimed in claim 12, wherein said guide means comprise:

a pair of elongate flat plates extending from the front to the rear walls of said frame along said centerline axis on the top and bottom flat sides of said frame;

said flat plates defining therebetween a pair of spaced, parallel wire-guiding surfaces;

said wire-guiding surfaces including cut-out portions accomodating said actuator armatures and movement of same;

a plurality of pins between said surfaces maintaining said spaced parallel relation and guiding said wires into contiguous relation; and an additional guide pin pair secured in said frame adjacent said nose and guiding all said wires thereinto.

15. The cartridge module as claimed in claim 11 and additionally comprising:

a vertical offset in the front and rear walls of said frame along said centerline, said offset dividing said frame into an upper half and a lower half;

actuators mounted on said upper half including print wires forming the upper portion of said linear array; and actuators mounted on said lower half including print wires forming the lower portion of said linear array.

16. The cartridge module as claimed in claim 11 or 12, and additionally comprising:

locator pins and corresponding holes in the rear wall of said frame;

at least one mounting rod hole in the front of said frame near said nose passing between said flat sides;

whereby, in conjunction with a mounting rod, a plurality of said modules may be assembled in a stack.

17. A stackable, dot matrix printing cartridge module comprising:

a cartridge body, said body comprising a flat, open-sided frame of generally rectangular shape and including on the inner, long sides of said frame a plurality of angled, electromagnet print-cell mounting surfaces, and on one short side a nose bearing for retaining a plurality of print-cell printing wires in a contiguous linear array, said linear array being perpendicular to said printing stroke planes and said flat sides;

a plurality of electromagnetic print cells mounted on said mounting surfaces, each said cell having an armature located near the centerline axis of said body and moveable in a printing stroke plane and including a print wire extending from said armature to said nose bearing:

said mounting surfaces being positioned so that each print wire in said linear array moves upon actuation of a cell without angular deviation from said printing stroke plane;

guide means along said centerline axis adapted to retain and guide each said print wire between said armature and said nose bearing within said printing stroke planes;

side walls adjacent each said mounting surface;

said side walls each increasing in thickness by one wire diameter with distance from said nose bearing;

said side walls being along the bottom of said frame along one long side and along the top of said frame along the opposed long side of said frame;

whereby print wires from the furthest actuators from said nose form the centermost wires of the linear array and print wires from the closest actuators form the outermost wires of said array.

18. The cartridge module as claimed in claim 17, wherein said angle to the centerline axis and the angle of said mounting surfaces are the same, said angle decreasing with distance from said nose bearing for successive pairs of mounting surfaces, from about 9° to about 5°.

19. The cartridge module as claimed in claim 17, and additionally comprising means to compensate for wire wear, said means comprising:

mounting screws adapted to secure said print cells onto said mounting surfaces from the exterior of said frame;

holes for said screws in said frame;

said holes being oversized.

20. A stackable, dot matrix printing cartridge module comprising:

a cartridge body, said body comprising a flat, open-sided frame of generally rectangular shape and including on the inner, long sides of said frame a plurality of angled, electromagnet print-cell mounting surfaces, and on one short side a nose bearing for retaining a plurality of print-cell printing wires in a contiguous linear array, said armatures and wires defining a single printing stroke plane, and said linear array also being in said plane, parallel to and between said flat sides;

a plurality of electromagnetic print cells mounted on said mounting surfaces, each said cell having an armature located near the centerline axis of said body and moveable in said printing stroke plane and including one said print wire extending from said armature to said nose bearing:

said mounting surfaces being positioned so that each print wire in said linear array moves upon actuation of a cell without angular deviation from said printing stroke plane;

guide means along said centerline axis adapted to retain and guide each said print wire between said armature and said nose bearing within said printing stroke plane;

each said mounting surface being closer to said centerline axis by one wire diameter with distance from said nose bearing;

whereby print wires from the furthest actuators from said nose form the centermost wires of the linear array, and print wires from the closest actuators form the outermost wires of said array.

21. The cartridge module as claimed in claim 20, wherein said angle to the centerline axis and the angle of said mounting surfaces are the same, said angle decreasing with distance from said nose bearing for successive pairs of mounting surfaces, from about 9° to about 5°.

22. The cartridge module as claimed in claim 20, and additionally comprising means to compensate for wire wear, said means comprising:

mounting screws adapted to secure said print cells onto said mounting surfaces from the exterior of said frame;

holes for said screws in said frame;

said holes being oversized.

* * * * *